US006570310B1

(12) United States Patent
Aibara

(10) Patent No.: US 6,570,310 B1
(45) Date of Patent: May 27, 2003

(54) SHADOW-MASK TYPE COLOR CATHODE-RAY TUBE

(75) Inventor: Nobumitsu Aibara, Shiga (JP)

(73) Assignee: NEC Corporation, Tokyo (JP)

( * ) Notice: Subject to any disclaimer, the term of this patent is extended or adjusted under 35 U.S.C. 154(b) by 1435 days.

(21) Appl. No.: 08/962,567

(22) Filed: Nov. 3, 1997

Related U.S. Application Data

(63) Continuation of application No. 08/600,770, filed on Feb. 13, 1996, now abandoned.

(30) Foreign Application Priority Data

Feb. 13, 1995 (JP) ..... 07/023583
Dec. 20, 1995 (JP) ..... 07-331629

(51) Int. Cl.[7] ..... H01J 29/07
(52) U.S. Cl. ..... 313/403; 313/408
(58) Field of Search ..... 313/402, 403, 313/404, 405, 406, 407, 408

(56) References Cited

U.S. PATENT DOCUMENTS 4,672,260 A * 6/1987 Prazak, III ..... 313/402
4,859,901 A * 8/1989 Thompson-Russell ..... 313/403
5,079,477 A * 1/1992 Yamamoto ..... 313/403
5,162,694 A * 11/1992 Capek et al. ..... 313/402
5,730,887 A * 3/1998 Simpson et al. ..... 313/403

FOREIGN PATENT DOCUMENTS

JP 2-103847 4/1990 ..... H01J/29/07

OTHER PUBLICATIONS

K. Naiki et al., *15–Inch Flat Face Vary High Resolution Color Display Tube*, NEC Res. & Develop., No 90, Jul. 1988.*

H. Yoshida et al., *High Resolution Color Display Tubes for Display Terminals*, Hitachi Review vol. 32, No 1, 1983 (No month).*

K. Hirabayash et al., *High Resolution Color Display Tube* National Technical Report vol. 25 No. 2, Apr. 1979.*

* cited by examiner

*Primary Examiner*—Michael H. Day
(74) *Attorney, Agent, or Firm*—Sughrue Mion, PLLC

(57) ABSTRACT

A color CRT equipped with a slot type shadow mask is provided, which enables to reduce the moire phenomenon without deteriorating its vertical resolution. The color CRT contains a shadow mask having slots allowing selectively electron beams to arrive at the phosphor screen through the mask. Each of the slots has an vertically elongated shape. The slots are arranged horizontally at a fixed horizontal pitch, and vertically at a fixed vertical pitch. At least two vertically adjacent ones of the slots have a bridge area therebetween. Each of the bridge areas serves as an electron-beam stopping area. In addition, at least two horizontally adjacent ones of the slots are vertically shifted at a fixed value equal to or greater than a half of the vertical pitch. The electron beams are scanned perpendicular to the slots. The vertical pitch of the slots is set at a value ranging from 0.2 mm to 0.5 mm. Each of the bridges preferably has a fixed vertical width ranging from 0.02 mm to 0.08 mm.

23 Claims, 4 Drawing Sheets

FIG. 4 (15 in., 100%)
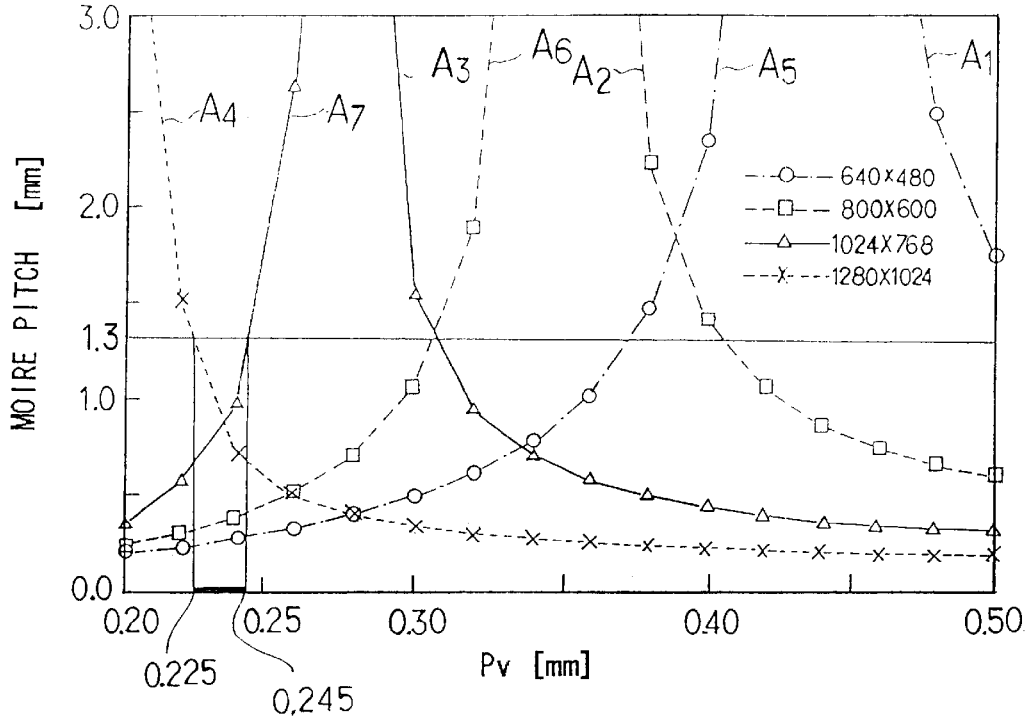
FIG. 5 (15in., 90%)
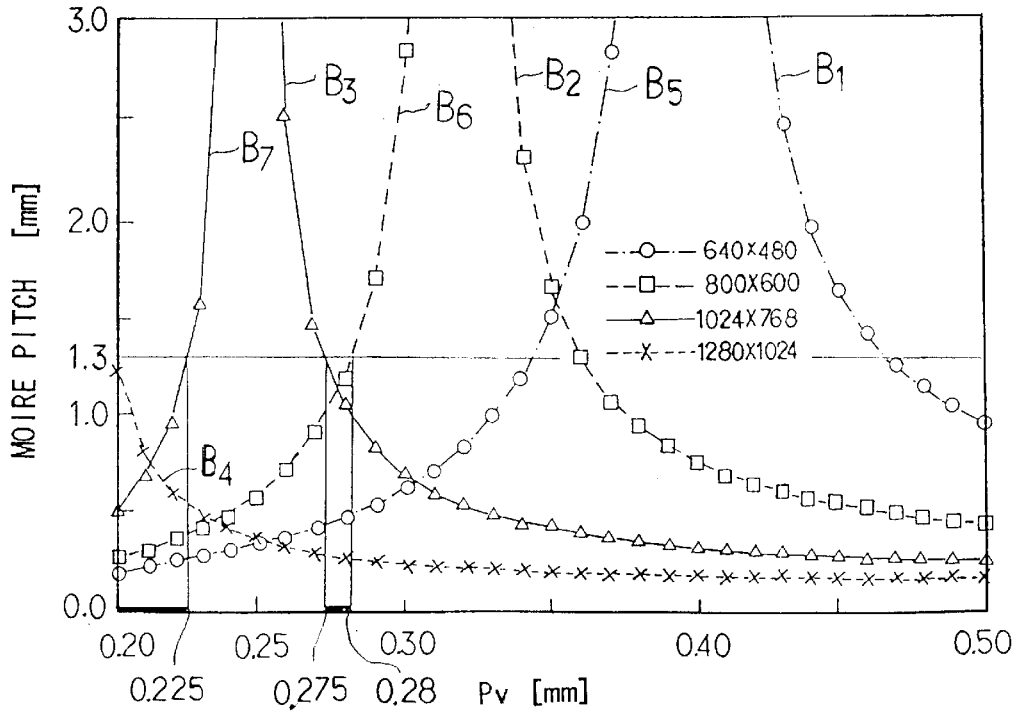

FIG. 6 (17 in., 100%)
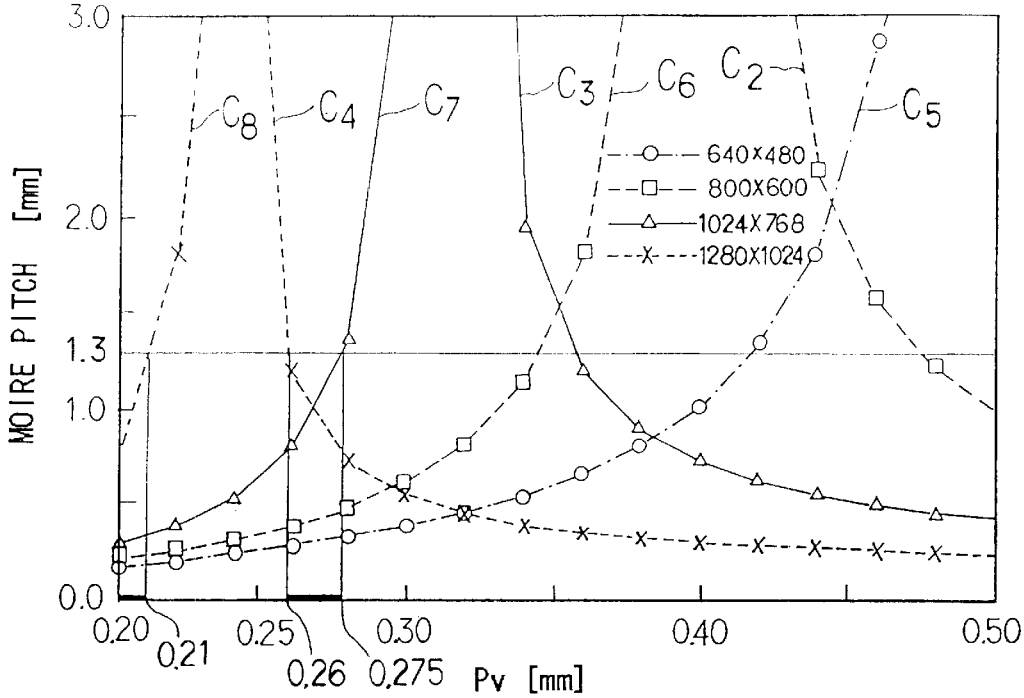
FIG. 7 (17 in., 90%)
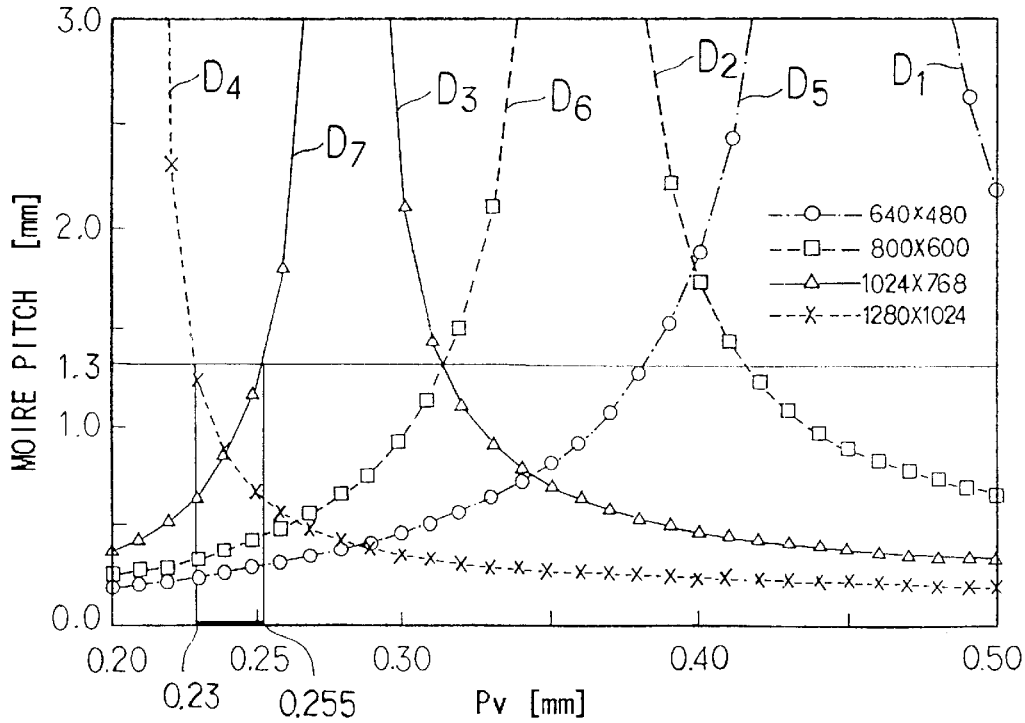

SHADOW-MASK TYPE COLOR CATHODE-RAY TUBE

This application is a continuation of Ser. No. 08/600,770 filed Feb. 13, 1996, now abandoned.

BACKGROUND OF THE INVENTION

1. Field of the Invention

The present invention relates to a shadow-mask type color-generating cathode-ray tube (color CRT) and more particularly, to a shadow-mask type color CRT equipped with a slot type shadow mask, which reduces the moire phenomenon without deteriorating its vertical resolution.

2. Description of the Prior Art

As shown in FIG. 1, a shadow mask 18 of a conventional shadow-mask type color CRT has a number of slots 17 allowing selectively electron beams emitted from three electron guns to arrive at a phosphor screen through the mask 18. The three electron beams for red (R), green (G) and blue (B) colors are deflected by horizontal and vertical deflecting magnetic fields generated by a deflection yoke in the horizontal and vertical directions X and Y of a face panel.

The three electron beams are horizontally scanned over the entire phosphor screen. On the other hand, the beams passing through the slots 17 in the shadow mask 18 strike the corresponding phosphor stripes arranged in the entire phosphor screen and excite them. Thus, a wanted color image is displayed on the face panel.

The slots 17, all of which have the same roughly rectangular shape, are regularly arranged to form a mosaic in the horizontal and vertical directions X and Y of the face panel. In other words, the slots 17 are arranged in a staggered pattern. Between any vertically adjacent slots 17, a bridge area 19 is formed to maintain the mechanical strength of the shadow mask 18.

Specifically, a given number of the slots 17 are arranged at a fixed vertical pitch Pv in the vertical direction Y, forming a slot column 17*a*. Another given number of the slots 17 are arranged at the same fixed vertical pitch $P_V$ in the vertical direction Y, forming another slot column 17*b*. A plurality of the slot columns 17*a* and a plurality of the slot columns 17*b* are alternately arranged in parallel in the horizontal direction Y. The columns 17*a* and 17*b* are arranged at a fixed horizontal pitch $P_H$.

The slot 17 in any one of the slot columns 17*b* is shifted in the vertical direction Y with respect to a corresponding one of the slots 17 in an adjacent one of the columns 17*a* by a half of the vertical pitch $P_V$, i.e., $(1/2)P_V$. In other words, the slots 17 are arranged so that, in any adjacent slot columns 17*a* and 17*b*, the horizontal center line of the bridge area 19 equally divides the opposed slot 17 into two in the vertical direction Y.

The fixed vertical pitch Pv is typically set at a value from 0.6 mm to 1.0 mm.

Each of the bridge areas 19 provides an electron-beam stopping area, which tends to create a shade on the phosphor screen, resulting in reduction in brightness. Also, the smaller the spot diameter of the electron beams, the larger the contrast on the phosphor screen, which makes the moire phenomenon remarkable.

To solve this problem, conventionally, the vertical pitch $P_V$ is varied to minimize the visibility of the moire within the shadow mask 18.

However, with the conventional shadow-mask type color CRT as stated above, when this CRT with the vertical pitch $P_V$ of 0.6 to 1.0 mm is used as a visual display terminal (VDT) in such an application as a computer display terminal, the shades produced by the bridge areas 19 tend to prevent the phosphor stripes from fluorescing at a part of the character and/or figure to be displayed, because the CRT requires a high resolution. This results in that the character cannot be read and/or the background and/or figure looks rough and non-uniform, making reading of the character still more difficult.

These shades further cause another problem of resolution deterioration.

Additionally, another conventional color CRT was disclosed in the Japanese Non-Examined Patent Publication No. 2-103847 published in April 1990. In this CRT, the vertical width $B_W$ of the bridge areas is varied at random under the condition of $\Delta \geqq B_W$, where $\Delta$ is a shift for any adjacent slot columns.

SUMMARY OF THE INVENTION

Accordingly, an object of the present invention is to provide a color CRT equipped with a slot-type shadow mask that enables to reduce the moire phenomenon without deteriorating its vertical resolution.

The object together with others not specifically mentioned will become clear to those skilled in the art from the following description.

A shadow-mask type color CRT according to the present invention includes a shadow mask fixed apart from a face panel and opposed to a phosphor screen. The mask has slots allowing selectively electron beams to arrive at the phosphor screen through the mask. Each of the slots has an vertically elongated shape. The slots are arranged horizontally at a fixed horizontal pitch, and vertically at a fixed vertical pitch. At least two of the vertically adjacent ones of the slots have a bridge area therebetween. Each of the bridge areas serves as an electron-beam stopping area. In addition, at least of the two horizontally adjacent ones of the slots are vertically shifted at a fixed value equal to or greater than a half of the vertical pitch. The electron beams are scanned perpendicular to the slots. The vertical pitch of the slots is set at a value ranging from 0.2 mm to 0.5 mm.

With the color cathode-ray tube according to the present invention, the slots of the shadow mask, which have a vertically elongated shape, are arranged horizontally at a fixed horizontal pitch and vertically at a fixed vertical pitch. Also, horizontally adjacent slots are vertically shifted at a fixed value equal to or greater than a half of the vertical pitch. Further, the vertical pitch of the slots is set at a value ranging from 0.2 mm to 0.5 mm. As a result, the moire phenomenon can be reduced without deteriorating its vertical resolution.

In a preferred embodiment, each of the bridges has a fixed vertical length ranging from 0.02 mm to 0.08 mm. In this case, the moire phenomenon can be further reduced without deteriorating its vertical resolution.

In another preferred embodiment, the vertical pitch of the slots is set at a value ranging from 0.2 mm to 0.275 mm or from 0.2 mm to 0.28 mm corresponding to a raster (or screen) size of the tube. In this case, the moire phenomenon can be suitably reduced corresponding to the raster (or screen) size without deteriorating its vertical resolution.

BRIEF DESCRIPTION OF THE DRAWINGS

In order that the invention may be readily carried into effect, it will now be described with reference to the accompanying drawings.

FIG. 4 is a graph showing the relationship between the vertical pitch $P_V$ and the moire pitch of a 15-in. color CRT according to a second embodiment of the present invention, in which the effective screen size is 100%.

FIG. 5 is a graph showing the relationship between the vertical pitch $P_V$ and the moire pitch of a 15-in. color CRT according to the second embodiment, in which the effective screen size is 90%.

FIG. 6 is a graph showing the relationship between the vertical pitch $P_V$ and the moire pitch of a 17-in. color CRT according to the second embodiment, in which the effective screen size is 100%.

FIG. 7 is a graph showing the relationship between the vertical pitch $P_V$ and the moire pitch of a 17-in. color CRT according to the second embodiment, in which the effective screen size is 90%.

DETAILED DESCRIPTION OF THE PREFERRED EMBODIMENTS

Figure 1:
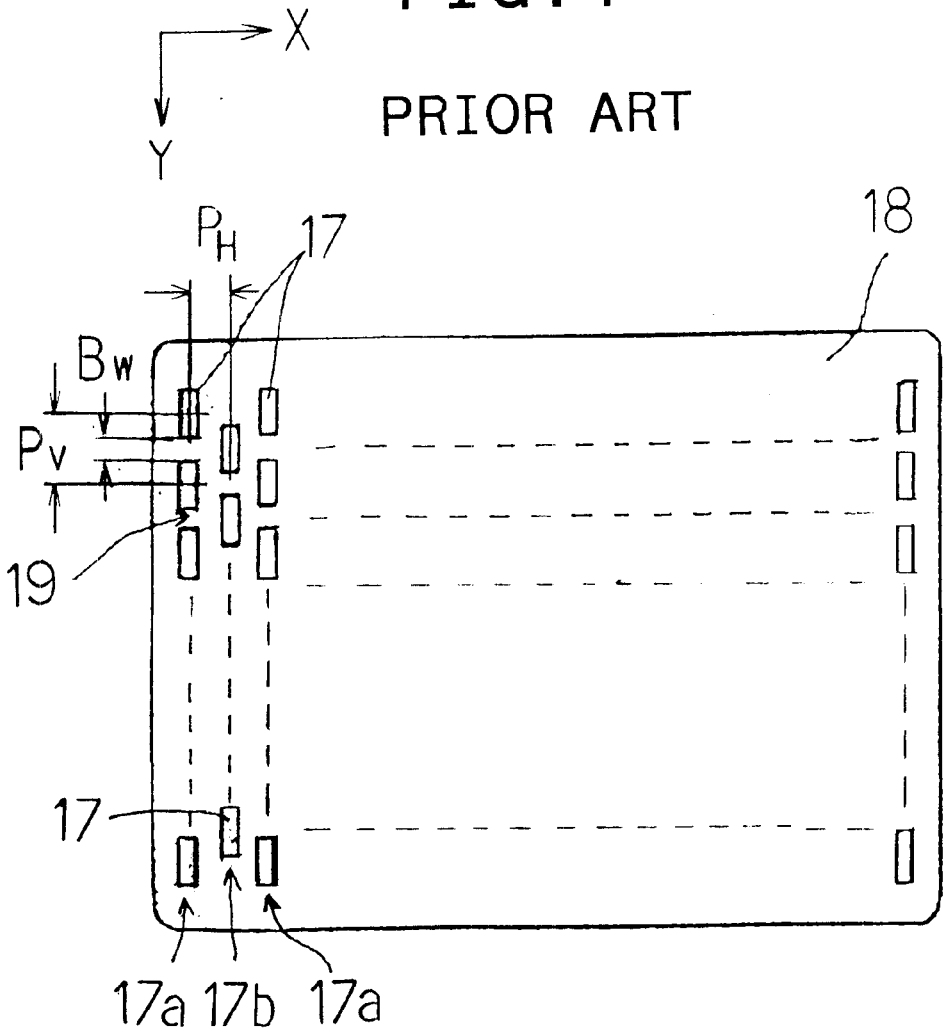
FIG. 1 PRIOR ART
FIG. 1 is a schematic plan view of a shadow mask of a conventional shadow-mask type color CRT.

Preferred embodiments of the present invention will be described in detail below while referring to the drawings attached.

First Embodiment

Figure 2:
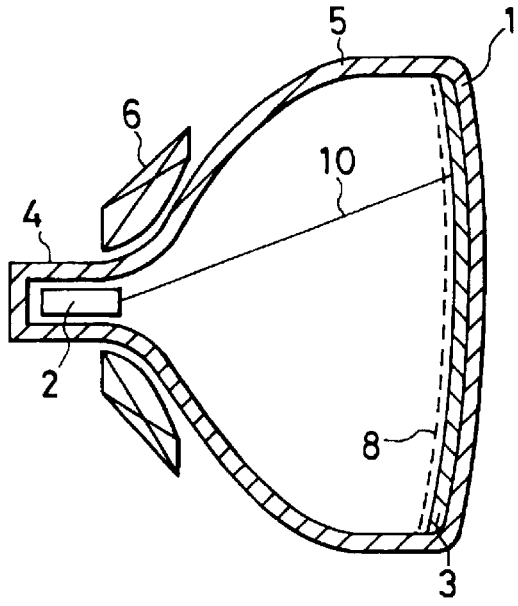
FIG. 2 is a schematic cross-sectional view of a shadow-mask type color CRT.

As shown in FIG. 2, a shadow-mask type color CRT according to a first embodiment of the present invention has a face panel 1 on which an image is displayed. The panel 1 is connected to a roughly cone-shaped funnel 5 having a tubular neck 4, thereby forming a vacuum container.

A phosphor screen 3 is formed onto and extends along the inner surface of the panel 1 in the container. A number of stripes of phosphor materials for red (R), green (g) and blue (B) colors are horizontally and vertically arranged in the entire screen 3. Each of the stripes is usually of a vertically elongated shape, i.e., of a vertically extending strip.

A shadow mask 8 is fixed apart from the panel 1 and opposed to the phosphor screen 3 in the container. The mask 8 has a number of slots 7 selectively allowing electron beams 10 to arrive at the phosphor screen 3 through the mask 8.

In the neck 4 of the funnel 5, three electron guns 2 for producing and emitting the electron beams 10 for R, G and B colors are loaded to be horizontally arranged in line. In other words, the guns 2 have the in-line structure. A deflection yoke 6 is provided around the funnel 5, which deflects horizontally and vertically the electron beams 10, respectively.

The electron beams 10 for R, G and B colors, which are emitted from the corresponding electron guns 2, are deflected by the horizontal and vertical deflecting magnetic fields generated by the deflection yoke 6, and horizontally scanned over the entire phosphor screen 3. The beams 10 passing through the slots 7 in the shadow mask 8 strike the corresponding stripes of the phosphor materials and excite them, thereby displaying a color image on the face panel 1.

Figure 3:
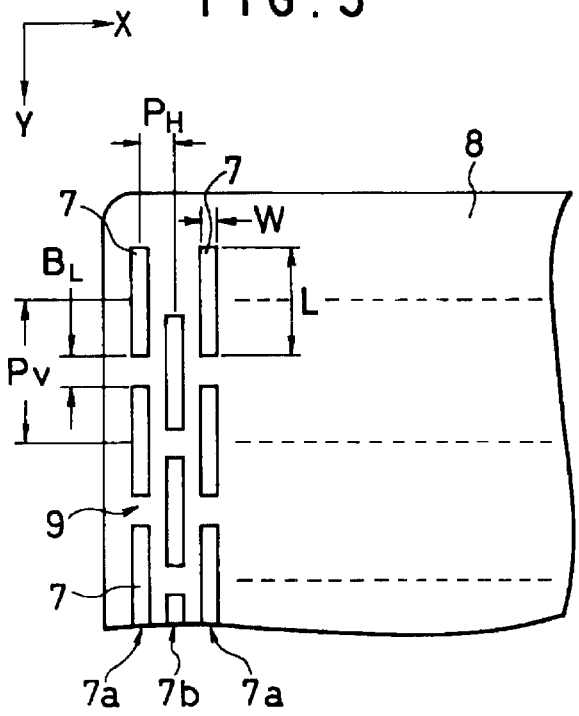
FIG. 3 is a schematic, enlarged, partial plan view of a shadow mask of a shadow-mask type color CRT according to a first embodiment of the present invention.

As shown in FIG. 3, the shadow mask 8, which is made of Invar alloy, has a number of approximately rectangular slots 7. The slots 7 are regularly arranged in the horizontal and vertical directions X and Y of the face panel 1, forming a pattern similar to a mosaic in the entire mask 18. In other words, the slots 7 are arranged in a staggered pattern. All the slots 7 have the same approximately rectangular shape.

Specifically, a given number of the slots 7 are arranged at a fixed vertical pitch $P_V$ in the vertical direction Y, forming a slot column 7*a*. Another given number of the slots 7 are arranged at the same fixed vertical pitch $P_V$ in the vertical direction Y, forming another slot column 7*b*. A plurality of the slot columns 7*a* and a plurality of the slot columns 7*b* are alternately arranged in parallel in the horizontal direction X. The columns 7*a* and 7*b* are arranged in the horizontal direction X at a fixed horizontal pitch $P_H$.

Each slot 7 of the slot columns 7*b* is shifted in the vertical direction Y with respect to a corresponding slot 7 of the slot columns 7*a* by a half of vertical pitch $P_V$, i.e., $(½)P_V$. In other words, the slots 7 are arranged so that, in any adjacent slot columns 7*a* and 7*b*, the horizontal center line of the bridge area 9 equally divides the opposed slot 7 into two in the vertical direction Y.

The fixed vertical pitch Pv is typically set at a value ranging from 0.2 mm to 0.5 mm.

Between any vertically adjacent slots 7, a bridge area 9 is formed to maintain the mechanical strength of the shadow mask 8. Each of the bridge areas 9, which provides an electron-beam stopping area, has a fixed vertical length $B_L$. The length $B_L$ is set at a value ranging from 0.02 mm to 0.08 mm.

The fixed horizontal pitch $P_H$ may be determined according to the display size. Here, $P_H$ is set at a value of 0.65 mm.

Since Pv=0.2 to 0.5 mm and $B_L$=0.02 to 0.08 mm in this embodiment, the length L of each slot 17 is in the range of 0.12 mm to 0.48 mm. On the other hand, the width W of each slot 7 may be determined according to the display size. Here, W is set at a value of 0.175 mm.

With the color CRT according to the first embodiment, the slots 7 of the shadow mask 8, each of which has the same vertically elongated shape, are arranged horizontally at the fixed horizontal pitch $P_H$ and vertically at the fixed vertical pitch $P_V$. Also, at least two horizontally adjacent ones of the slots 7 are vertically shifted at the fixed value of $(½)P_V$. Further, the vertical pitch $P_V$ of the slots 7 is set at a value ranging from 0.2 mm to 0.5 mm and the vertical length $B_L$ of the bridge area 9 is set at a value ranging from 0.02 mm to 0.08 mm. As a result, the moire phenomenon can be reduced without deteriorating its vertical resolution.

The above value ranges of $P_V$ and $B_W$ were obtained by tests that were performed under the condition that the bridge length $B_L$ for the bridge areas 9 was fixed at a value of 0.1 mm and the horizontal pitch $P_H$ for the slot columns 7*a* and 7*b* was fixed at a value of 0.25 mm, while the vertical pitch $P_V$ for the slots 7 was varied as a parameter from 0.2 to 2.0 mm. The results of the tests were evaluated with respect to the resolution, the visibility of the moire phenomenon, and the brightness. The conclusion as given is listed in the following Table 1.

TABLE 1

| SLOT PITCH $P_V$ [mm] | BRIDGE LENGTH $B_L$ [mm] | RESOLUTION | VISIBILITY OF MOIRE | BRIGHTNESS |
|---|---|---|---|---|
| 2.0 | 0.1 | x | x | ○ |
| 1.0 | 0.1 | x | Δ | ○ |
| 0.5 | 0.1 | Δ | ○ | ○ |
| 0.4 | 0.1 | ○ | ○ | ○ |
| 0.3 | 0.1 | ○ | ○ | Δ |
| 0.2 | 0.1 | ○ | ○ | x |

In Table 1, the symbol ○ means "GOOD", Δ means "FAIR", and X means "POOR".

With a 15-in. color CRT, for example, which is being used as a visual display terminal, the high resolution display mode of 1024×768 dots provides a vertical signal pitch of (210/768)=0.273 mm per dot for the vertical screen dimension of 210 mm. It is found that, because the slot columns 7*a* and 7*b* are arranged with a displacement of (½)$P_V$ in the vertical direction Y, the desirable vertical pitch $P_V$ for the slots 7 for obtaining a sufficient resolution is 0.546 mm or smaller.

However, the above test results showed that, as given in Table 1, the vertical pitch $P_V$ of over 0.5 mm offers an insufficient resolution, thereby making characters difficult in the displayed image to be read. Therefore, it is preferred that the vertical pitch $P_V$ is equal to 0.5 mm or less.

Also, since the shadow mask 8 has the bridges 9, a shadow is necessarily produced by the bridges 9, resulting in that the background of the characters displayed in the image looks coarse or non-uniform, and/or the brightness is lowered. This phenomenon becomes remarkable as the vertical pitch $P_V$ decreases in value.

In Table 1, when the vertical pitch $P_V$ is 0.2 mm, the evaluation of the brightness is not always good, however, this is due to the bridge length $B_L$ of 0.1 mm, and by decreasing this value of $B_L$, the brightness level will be improved to one presenting no problem.

Therefore, it is seen that the vertical pitch $P_V$ is preferably set as a value ranging from 0.2 mm to 0.5 mm.

Generally, the resolving power of the eyes of a human being is approximately 0.5 minute in viewing angle. Also, it can be assumed that the least distance of distinct vision is approximately 30 cm when such the CRT is ordinarily used as a VDT; thus, the resolution for the eyes becomes 0.05 to 0.08 mm on the screen. Therefore, if the length $B_L$ of the bridges 9 is smaller than this value, it is difficult for a human being to recognize the bridge shadow independent of the vertical pitch $P_V$ for the slots 7. Further, the coarseness and non-uniformity of the background of the displayed image cannot be easily conspicuous, and the decrease in brightness can be controlled or restrained.

However, narrowing the length $B_L$ of the bridges 9 reduces the area to hold the horizontal geometry of the shadow mask 8 and as a result, the desired curvature cannot be maintained. Also, since the shadow mask 8 is formed by etching away the slots 7, the thickness of the mask 8 must be decreased in order to narrow the bridge length $B_L$. This also causes the shadow mask strength to be lowered. Consequently, to mechanically maintain the geometry of the shadow mask 8, the bridge length $B_L$ of at least 0.02 mm is required.

Accordingly, it is seen that the bridge length $B_L$ is preferably set at a value ranging from 0.02 mm to 0.08 mm.

Second Embodiment

It is expected that color CRTs for use as a VDT will be more highly precision or resolution in the future. Recently, color CRTs provided with a high resolution display mode of 1280×1024 dots have been put on the market. As a matter of course, the above-mentioned moire phenomenon is critical, and for any display modes, it is necessary to restrain the moire phenomenon as much as possible. Thus, it is essential to identify or find an optimum condition to determine the vertical pitch $P_V$ for the slots 7 for all high-resolution display modes.

Then, the inventor carried out the simulation and testing fabrication for 15-in. and 17-in. color CRTs, and as a result, he identified the following condition.

FIGS. 4 to 7 show the relationships between the vertical pitch $P_V$ of the slots 7 and the moire pitch for the 15-in. and 17-in. color CRTs, respectively, which were obtained by simulation. As shown in FIGS. 4 to 7, for each of the high-resolution display modes of 640×480, 800×600, 1024×768, and 1280×1024 dots, there is a certain point beyond which the moire pitch is greatly changed for a given change in the vertical pitch $P_V$.

The limit of moire pitch that allows a human being to detect the moire phenomenon is indefinite due to the difference between individuals; however, empirically and judging from the results of trial fabrication and testing, it can be set at a value of 2 to 3 mm. Considering the detection limit, it is recommended to avoid the region beyond this limit in setting the vertical pitch $P_V$ for the slots 7.

The inventor determined the limit to be 1.3 mm in consideration with fluctuation or variation due to the subjective judgment. In this case, as shown in FIG. 4, the vertical pitch $P_V$ that can satisfactorily control the moire phenomenon in any of the above-mentioned principal display modes is 0.225 mm to 0.245 mm in the 100% effective display area (210 mm) for 15 in.

In FIG. 4, the curves A1 and A5 are for the mode of 640×480 dots, the curves A2 and A6 are for the mode of 800×600 dots, the curves A3 and A7 are for the mode of 1024×768 dots, and the curve A4 is for the mode of 1260×1024 dots. The above values of 0.225 mm and 0.245 mm are given by the intersections of the curves A4 and A7 with the 1.3 mm level line of the moire pitch, respectively.

Also, for 17 in., it is 0.2 mm to 0.21 mm or 0.26 to 0.275 mm in the 100% effective display, area (240 mm), as shown in FIG. 6.

In FIG. 6, the curve C5 is for the mode of 640×480 dots, the curves C2 and C6 are for the mode of 800×600 dots, the curves C3 and C7 are for the mode of 1024×768 dots, and the curves C4 and C8 are for the mode of 1280×1024 dots. The above value of 0.21 mm is given by the intersection of the curve C8 with the 1.3 mm level line of the moire pitch. The above value of 0.26 mm and 0.275 mm are given by the intersections of the curves C4 and C7 with the 1.3 mm level line of the moire pitch, respectively.

With the latest VDTs applicable to computers, the users can change the raster or display size. Then, in consideration with this capability, assuming that 90% of the effective display area is used, the vertical pitch $P_V$ becomes 0.2 mm to 0.225 mm or 0.275 mm to 0.28 mm for 15 in. because its reduced raster size is 190 mm, as shown in FIG. 5.

In FIG. 5, the curves B1 and B5 are for the mode of 640×480 dots, the curves B2 and B6 are for the mode of 800×600 dots, the curves B3 and B7 are for the mode of 1024×768 dots, and the curve B4 is for the mode of 1280×1024 dots. The above value of 0.225 mm is given by the intersection of the curve B7 with the 1.3 mm level line of the moire pitch. The above value of 0.275 mm and 0.28 mm are given by the intersections of the curves B3 and B6 with the 1.3 mm level line of the moire pitch, respectively.

Similarly, for 17 in., the vertical pitch is 0.23 mm to 0.255 mm, as shown in FIG. 7, because its reduced raster size is 215 mm.

In FIG. 7, the curves D1 and D5 are for the mode of 640×480 dots, the curves D2 and D6 are for the mode of 800×600 dots, the curves D3 and D7 are for the mode of 1024×768 dots, and the curve D4 is for the mode of 1280×1024 dots. The above values of 0.23 mm and 0.255 mm are given by the intersections of the curves D4 and D7 with the 1.3 mm level line of the moire pitch, respectively.

Based on these results, it is seen that the vertical pitch $P_V$ is preferably set at a value ranging from 0.2 mm to 0.28 mm for 15 in. and at a value of 0.2 mm to 0.275 mm for 17 in.

For 15 in., the vertical pitch $P_V$ is preferably set at a value ranging from 0.225 mm to 0.245 mm for the 100%-effective display area, and from 0.2 mm to 0.225 mm for the 90%-efective display area. Therefore, $P_V$ may be set at a value ranging from 0.2 mm to 0.245 mm.

For 17 in., the vertical pitch $P_V$ is preferably set at a value ranging from 0.2 mm to 0.21 mm or from 0.26 mm to 0.275 mm for the 100%-efective display area, and from 0.23 mm to 0.255 mm for the 90%-effective display area. Therefore $P_V$ may be set at a value ranging from 0.23 mm to 0.275 mm, because almost the same performance is obtained in the range from 0.255 mm to 0.26 mm.

Whether the moire phenomenon can be visually recognized or not depends upon the contrast in addition to the moire pitch. In other words, if the contrast is too low, the moire cannot be easily seen. Generally, the width of one scanning line of the electron beam 10 is approximately 0.3 mm to 0.7 mm. In any of the above-mentioned display modes, when the number of vertical dots is increased to over 700 for 15 in. and 800 for 17 in., the scanning lines begin to overlap one another, resulting in the lowered contrast. Therefore, for a given moire pitch, the larger the number of the dots, the lower the contrast, and as a result, the moire will become more difficult to be visually recognized. If the moire having a pitch as large as over 2 mm were produced, no problem would occur.

Consequently, although the limit level of the moire pitch is set as a value of 1.3 mm in the second embodiment, it may be set as a value of over 1.3 mm (for example, 2 mm) when the contrast is comparatively low.

With the color CRT according to the second embodiment, the vertical pitch $P_V$ for the slots 7 is set as at a value ranging from 0.2 mm to 0.275 mm or 0.2 mm to 0.28 mm. Therefore, either of the ranges can be selected depending upon the particular screen size of the CRT so that the moire phenomenon is reduced without deteriorating its vertical resolution.

While the preferred forms of the present invention have been described, it is to be understood that modifications will be apparent to those skilled in the art without departing from the spirit of the invention. The scope of the invention, therefore, is to be determined solely by the following claims.

What is claimed is:

1. A shadow-mask type color cathode-ray tube comprising:

a face panel on which an image is displayed;

a funnel connected to said face panel, said funnel and said face panel forming a vacuum container;

electron guns for producing electron beams for red, green and blue colors, said guns being horizontally arranged in line;

a deflection yoke provided around said funnel, said yoke deflecting said electron beams;

a phosphor screen formed on an inner surface of said face panel in said container;

said screen having stripes of phosphor materials for red, green and blue colors, said stripes being horizontally arranged in said screen;

a shadow mask fixed apart from said face panel and opposed to said phosphor screen in said container;

said shadow mask having slots which selectively allow said electron beams to arrive at said phosphor screen through said mask, each of said slots having a vertically elongated shape; said electron beams being scanned perpendicular to said slots;

said slots being arranged horizontally at a fixed horizontal pitch with respect to each other;

said slots being arranged vertically at a fixed vertical pitch with respect to each other;

wherein at least two vertically adjacent ones of said slots each have a bridge area therebetween, said bridge area serving as an electron-beam stopping area;

wherein at least two horizontally adjacent ones of said slots are vertically shifted a fixed distance relative to each other, said fixed distance being equal to approximately a half of said vertical pitch; and wherein said vertical pitch of said slots is set at a value ranging from 0.2 mm to 0.5 mm and is defined relative to centers of said slots.

2. The color cathode-ray tube as claimed in claim 1, wherein each of said bridges has a fixed vertical length ranging from 0.02 mm to 0.08 mm.

3. The color cathode-ray tube as claimed in claim 1, wherein said vertical pitch of said slots is set at a value ranging from 0.2 mm to 0.275 mm.

4. The color cathode-ray tube according to claim 3, wherein said face panel has an approximate diagonal length of 17 inches.

5. The color cathode-ray tube as claimed in claim 1, wherein said vertical pitch of said slots is set at a value ranging from 0.2 mm to 0.28 mm.

6. The color cathode-ray tube according to claim 5, wherein said face panel has an approximate diagonal length of 15 inches.

7. The color cathode-ray tube as claimed in claim 1, wherein said vertical pitch of said slots is set at a value ranging from 0.225 mm to 0.245 mm.

8. The color cathode-ray tube according to claim 7, wherein said face panel has an approximate diagonal length of 15 inches and an effective display area of 100 percent.

9. The color cathode-ray tube as claimed in claim 1, wherein said vertical pitch of said slots is set at a value ranging from 0.2 mm to 0.21 mm.

10. The color cathode-ray tube according to claim 9, wherein said face panel has an approximate diagonal length of 17 inches and an effective display area of 100 percent.

11. The color cathode-ray tube as claimed in claim 1, wherein said vertical pitch of said slots is set at a value ranging from 0.26 mm to 0.275 mm.

12. The color cathode-ray tube according to claim 11, wherein said face panel has an approximate diagonal length of 17 inches and an effective display area of 100 percent.

13. The color cathode-ray tube as claimed in claim 1, wherein said vertical pitch of said slots is set at a value ranging from 0.2 mm to 0.225 mm.

14. The color cathode-ray tube according to claim 13, wherein said face panel has an approximate diagonal length of 15 inches and an effective display area of 90 percent.

15. The color cathode-ray tube as claimed in claim 1, wherein said vertical pitch of said slots is set at a value ranging from 0.275 mm to 0.28 mm.

16. The color cathode-ray tube as claimed in claim 1, wherein said vertical pitch of said slots is set at a value ranging from 0.23 mm to 0.255 mm.

17. The color cathode-ray tube according to claim 16, wherein said face panel has an approximate diagonal length of 17 inches and an effective display area of 90 percent.

18. The color cathode-ray tube as claimed in claim 1, wherein said vertical pitch of said slots is set at a value ranging from 0.2 mm to 0.245 mm.

19. The color cathode-ray tube according to claim 18, wherein said face panel has an approximate diagonal length of 15 inches, and an effective display area between 90 and 100 percent.

20. The color cathode-ray tube as claimed in claim 1, wherein said vertical pitch of said slots is set at a value ranging from 0.23 mm to 0.275 mm.

21. The color cathode-ray tube according to claim 20, wherein said face panel has an approximate diagonal length of 17 inches, and an effective display area between 90 and 100 percent.

22. The color cathode-ray tube according to claim 1, wherein said shadow mask is made of invar alloy.

23. The color cathode-ray tube according to claim 1, wherein said slots are rectangular in shape.

* * * * *

UNITED STATES PATENT AND TRADEMARK OFFICE

CERTIFICATE OF CORRECTION

PATENT NO. : 6,570,310 B1
DATED : May 27, 2003
INVENTOR(S) : Nobumitsu Aibara

It is certified that error appears in the above-identified patent and that said Letters Patent is hereby corrected as shown below:

Column 6,
Line 42, delete “1260” and insert -- 1280 --.

Column 7,
Line 27, delete “efective” and insert -- effective --.

Signed and Sealed this

Second Day of December, 2003

JAMES E. ROGAN
*Director of the United States Patent and Trademark Office*